United States Patent [19]

Klein

[11] 3,951,298

[45] Apr. 20, 1976

[54] GATED CAN LID WITH AN INTERRUPTED TRIPLEFOLD GATE PANEL CONSTRUCTION

[76] Inventor: Gerald B. Klein, 13451 Stuart Court, Broomfield, Colo. 80020

[22] Filed: Sept. 11, 1975

[21] Appl. No.: 612,540

[52] U.S. Cl. ..... 220/268

[51] Int. Cl.[2] ..... B65D 41/32

[58] Field of Search ..... 220/268, 273, 270, 90.6; 222/541

[56] References Cited

UNITED STATES PATENTS

| | | | |
|---|---|---|---|
| 3,334,775 | 8/1967 | Klein et al. | 220/268 |
| 3,411,661 | 11/1968 | Perry | 220/273 |
| 3,779,417 | 12/1973 | Klein | 220/268 |
| 3,794,206 | 2/1974 | Deline et al. | 220/268 |
| 3,880,316 | 4/1975 | Martella | 220/268 |

*Primary Examiner*—George T. Hall

*Attorney, Agent, or Firm*—Cantor & Kraft

[57] ABSTRACT

An improved can lid of the type including a gate structure defining a normally closed aperture so as to facilitate removal of the contents of the can is disclosed. The lid is constructed from a continuous blank of a sheet metal member which is drawn and shaped to provide an aperture in the surface of the member as well as a gate panel underneath the aperture normally closing same. The surface of the sheet metal member is underfolded about only a portion of the periphery of the aperture as a 180° outward underfold to form a narrow spacer strip at the underside of the lid about the underfolded portion of the periphery of the aperture. The sheet metal member is then infolded about the outer edge of the spacer strip as a 180° inward underfold to continuously merge into the metal sheet portion constituting the gate panel. In conventional fashion, a score line is cut about the edge of the gate panel adjacent to the 180° inward underfold so as to permit the gate panel to be severed from the spacer strip at the score line by downwardly applied pressure.

3 Claims, 7 Drawing Figures

GATED CAN LID WITH AN INTERRUPTED TRIPLEFOLD GATE PANEL CONSTRUCTION

BACKGROUND OF THE INVENTION

This invention generally relates to lids for liquid-containing cans, and more particularly relates to pre-formed lid constructions for cans which permits the cans to be opened without the use of can openers. The prepared opening in the can lid will be hereinafter called an "aperture", the structure which initially covers this aperture will be called a "gate," and the invention set forth herein will be generally referred to as a "gated can lid." This invention further specifically relates to an improvement in the gated can lid structure disclosed in U.S. Pat. No. 3,334,775 issued Aug. 8, 1967.

In U.S. Pat. No. 3,334,775, a gated can lid is disclosed of the type wherein a continuous blank of a planar or flat sheet metal member is drawn and shaped so as to provide an aperture in the surface of such member and a gate panel underneath the aperture adapted to normally close same, the so-shaped sheet metal member defining a lid for attachment to the walls of a liquid-containing can, for example. The construction of the lid is further such that the gate panel disposed underneath the aperture can be opened through the application of downward pressure thereupon so as to thus facilitate emptying of the contents of the can.

To this end, the construction of the gated can lid of U.S. Pat. No. 3,334,775 is such that the surface of the lid is underfolded about the edge of the aperture as a 180° outward underfold to form a narrow spacer strip at the under side of the lid about the edge of the aperture, the metal sheet thence being infolded about the outer edge of the spacer strip as a 180° inward underfold to merge into the metal sheet portion constituting the gate panel, a score line being cut about the edge of the gate panel adjacent to the 180° inward underfold which is adapted to permit the gate panel to be severed from the spacer strip and pushed downwardly into the can by the application of pressure thereon.

The gated can lid of U.S. Pat. No. 3,334,775 constituted a marked advance in the art which enabled the economical construction of pre-formed can lids having prepared openings therein. As successful as such construction has been, however, certain disadvantages thereof have now been discovered. For example, in such prior construction, the underfolding of the sheet metal member was contemplated to take place about the entire periphery of the aperture, even at such portion of the aperture which defined a hinge which served to maintain the gate panel in attachment with the can lid after the gate panel had been opened by the application of downward pressure thereto.

In those embodiments of the gated can lid wherein the aperture was located near the periphery of the lid, i.e., near the edge of the lid which was attached to the can body by means of a folded interconnecting seam, it has been found that the metal drawing operation necessary to provide such underfold might adversely weaken the interconnecting seam and adjacent area, this weakening bringing about an increased risk of leakage of the contents of the can.

BRIEF SUMMARY OF THE INVENTION

It is therefore apparent that a need exists in this art for a gated can lid construction which constitutes an improvement over the prior-art lid constructions of the type disclosed in U.S. Pat. No. 3,334,775 and which eliminates this disadvantage of potential weakening of the interconnecting seam and the adjacent can lid area. It is the primary objective of the instant invention to provide such an improved gated can lid construction.

This primary objective of the instant invention, as well as others which will become apparent as the description proceeds, are implemented by the provision of an improved lid for a can including a gate structure which defines a normally closed aperture therein so as to facilitate removal of the contents of the can. The lid comprises a generally planar sheet metal member, the outer periphery of which is adapted for attachment to a can body. In prior-art fashion, the sheet metal member is drawn and shaped so as to provide an aperture in the surface of the member as well as a gate panel underneath the aperture normally closing same, the surface of the sheet metal member being underfolded about the periphery of the aperture as a 180° outward underfold to form a narrow spacer strip at the underside of the lid about the periphery of the aperture, the sheet metal member thence being infolded about the outer edge of the spacer strip as a 180° inward underfold to continuously merge into the metal sheet portion constituting the gate panel. Again, in prior-art fashion, a score line is cut about the edge of the gate panel adjacent to the 180° inward underfold adapted to permit the gate panel to be severed from the spacer strip at the score line by downwardly applied pressure on the gate panel. A lanced opening may further be included along at least a portion of the score line to facilitate the initiation of the tearing and severing of the score line whenever the gate is pushed downwardly.

Importantly, and at the point of departure of this invention from the prior-art, the inventive construction constitutes a marked improvement in those embodiments of such gated can lids wherein the aperture in the surface of the sheet metal member and the gate panel underneath the aperture are disposed at a non-central location in the can lid, i.e., disposed at a location towards the wall of the can body. Under such circumstances, the underfolded portion of the sheet metal member about the periphery of the aperture is actually interrupted, i.e., does not extend about the entire periphery of the aperture, Specifically, that portion of the periphery of the gate panel which is nearest the wall of the can body is not folded or otherwise drawn but rather is left intact to define a hinge for the gate panel. By not underfolding that portion of the periphery of the aperture nearest the can wall, i.e., nearest the point of attachment of the can lid to the can body, no weakening of the interconnecting seam between the can lid and the can body results. Thus, a better and more reliable can lid is ensured of the type disclosed in U.S. Pat. No. 3,334,775.

BRIEF DESCRIPTION OF THE DRAWINGS

The invention itself will become better understood and further features and advantages thereof will become apparent from the following detailed description of the inventive embodiment, such description making reference to the appended single sheet of drawings wherein.

DETAILED DESCRIPTION OF THE PREFERRED INVENTIVE EMBODIMENT

Figure 1:
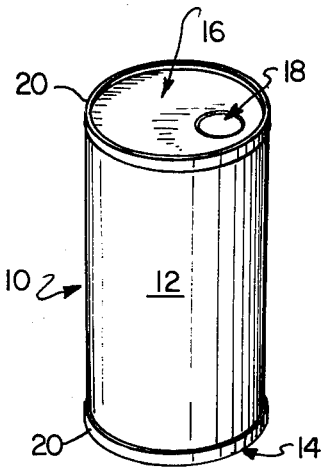
FIG. 1 is an isometric view of a can having a gate formed in the lid thereof and constructed according to the principles of the invention.
Figure 2:
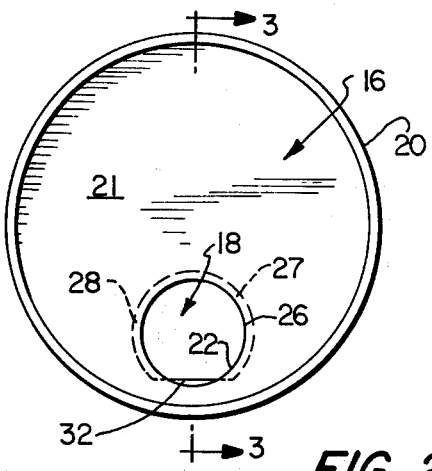
FIG. 2 is a top plan view of the can illustrated at FIG. 1 with dotted lines showing an edge portion hidden from view.

With particular reference now to FIGS. 1 and 2 of the application drawings, a metal can 10 is disclosed having a generally cylindrical upstanding wall portion 12 closed at the bottom by a flat circular bottom lid 14 and having a lid 16 with a gate panel 18 therein disposed at the top, the top and bottom lids 16 and 14, respectively, being joined to the wall 12 of the can 10 by an interconnecting seam 20 of conventional construction.

The can lid comprises a generally planar sheet metal member 21 which includes an aperture 22 through the surface of the lid, aperture 22 normally being closed by the gate panel 18 which is slightly larger than the aperture and which underlies the aperture as will be hereinafter described. This aperture may be of any form, though for purposes of convenience in description, the aperture is illustrated herein as being circular. The aperture 22 extends across a substantial portion of the can lid generally symmetrically to the diameter thereof as along the indicated line 3—3, though such aperture typically is disposed at a non-central location in the can lid towards the wall of the can body as is shown.

Figure 5:
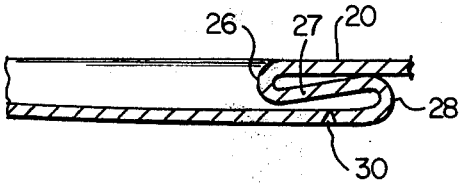
FIGS. 5 thru 7 inclusive are fragmentary sectional views depicting steps of a method which may be used to form the gate of FIGS. 2 thru 4.
Figure 5:
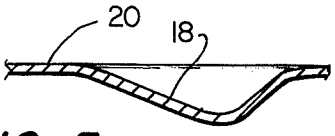
Figure 7:
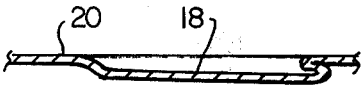
Figure 6:
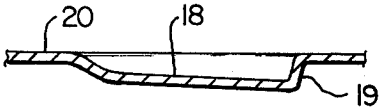

The aperture 22 and the underlying gate panel 18 are formed from the same blank of metal constituting the can lid 16 by a sequence of drawing operations. Such operations are conventional and consist generally in the steps of drawing the sheet metal portion constituting the gate panel inwardly, first, to a flat bottom cup-like member as depicted in FIG. 5, for example, and then enlarging the bottom area of this member as shown in FIG. 6, and returning it to a position adjacent to the aperture as is depicted in FIG. 7, for example, with the edge portion 19 being folded outwardly and underneath the aperture edge and finally against and between the surfaces of the gate and lid to constitute a spacer strip about the edge where the enlarged gate panel underlaps the aperture.

Figure 3:
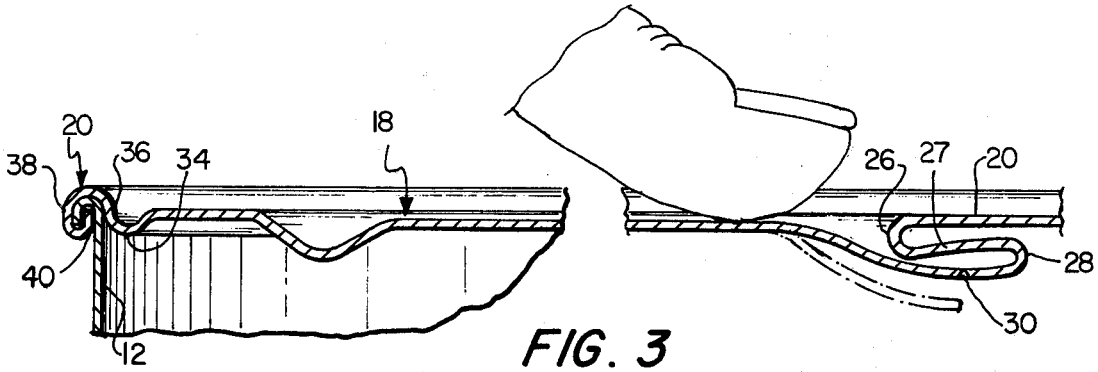
FIG. 3 is a transverse sectional detail of the top portion of the can as taken from the indicated line 3—3 of FIG. 2, but on an enlarged scale with the outline of an individual's thumb pressing against the lid to open the gate portion, and with broken lines indicating the movement of the gate into the can when it is opened.
Figure 4:
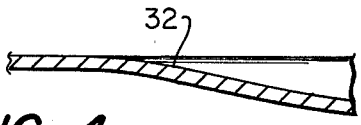
FIG. 4 is a transverse sectional detail showing a variant of the embodiment of FIG. 3.

The finally folded structure illustrated in section in FIG. 3, as well as the variant thereof depicted in FIG. 4, provides for a 180° fold edge 26 substantially completely about the aperture 22, and with the fold edge 26 merging into the narrow spacer strip 27 underneath the can lid about a substantial portion of the edge of the aperture. Spacer strip 27 terminates as a second 180° folded edge 28 to merge into the peripherial edge of the gate panel which underlays the aperture. It is to be noted that the structure shown in FIGS. 3 and 4, while being illustrative of the final construction, is distorted somewhat because the folds 26 and 28 will actually be tightly closed by the final movements of the drawing and forming machinery.

To render the gate panel 18 more easily separable from the can lid, it is scored at its peripherial edge at, or adjacent to, the 180° fold 28 by a comparatively deep, continuous score cut 30. Further, and in conventional fashion, the score cut may be lanced along its entire periphery or only at selected portions thereof to facilitate the tearing and severing of the score line whenever the gate is pushed downwardly into the dotted line position shown in FIG. 3 of the application drawings.

It is to be noted that only a portion of the periphery of the aperture 22 is underfolded at the 180° outward underfold. It is contemplated that a non-folded portion indicated by reference numeral 32 be left along that portion of the periphery of the aperture 22 nearest to the interconnecting seam 20 between the can lid 16 and the can body 12. This un-folded portion 32 will, for one, define a hinge about which gate panel 18 will swing when downward pressure is applied thereto, gate panel 18 thereby remaining at least partially attached to the can lid 16 even though the aperture is opened. In addition, the even more importantly, by leaving portion 32 in an un-folded fashion, no weakening of the connecting seam 20 or adjacent lid area between the can lid 16 and the can body 12 will occur because a minimum, if any, of metal is pulled from the peripheral area.

In this respect, specific attention is again directed to FIG. 3 of the application drawings wherein the detailed construction of the continuous seam 20 interconnecting the can lid 16 to the can body 12 is shown. Such continuous seam 20, at least insofar as relates to the can lid, will be seen to have a chuck panel 34 merging into a chuck wall 36, a seaming panel 38, and an end hook 40, all as is conventional, with the dimensions of these parts and the interconnecting radius of each being critical to form a seal with the wall 12 of the can body.

If the underfold forming the gate panel 18 extended about the entire periphery of the apperture 22 as is the case in prior-art constructions, the metal deformation and drawing necessary to provide such underfold would tend to draw metal from various ones of elements constituting the continuous seam 20 as above-described and would consequently serve to weaken or distort such seam, thereby weakening the lid at these peripheral areas. This weakening is completely avoided by the instant invention by interrupting the underfold as at portion 32, while actually facilitating the construction of a gated can lid of the type illustrated in U.S. Pat. No. 3,334,775.

Lastly, and as will be appreciated by those skilled in the art, a sealing mechanism typically is provided for gated can lids of the type herein described. Such sealing mechanism can take the form of a varnish-like resin covering the underside of the gate structure and portions of the lid such as described in U.S. Pat. No. 3,334,775, or may take the improved form of the application of a wax-like substance applied to the top of the can aperture and which, through capillary action, flows into the folds of the gated panel and thence into the lanced opening and score line provided as is illustrated in U.S. Pat. No. 3,905,513 to be issued on Sept. 16, 1975.

It should now be apparent that the primary objective of the instant invention set forth at the outset of this specification has been successfully achieved. Accordingly,

What is claimed is:

1. An improved lid for a can including a gate structure defining a normally closed aperture therein so as to facilitate removal of the contents of the can, said lid comprising a generally planar sheet metal member the outer periphery of which is adapted for attachment to a can body, said sheet metal member being drawn and shaped to provide an aperture in the surface of said member as well as a gate panel underneath the aperture normally closing same, the surface of the sheet metal member being underfolded about only a portion of the periphery of said aperture as a 180° outward underfold to form a narrow spacer strip at the underside of the lid about said portion of the periphery of said aperture, said sheet metal member thence being infolded about the outer edge of said spacer strip as a 180° inward underfold to continuously merge into the metal sheet portion constituting the gate panel, and a score line cut about the edge of said gate panel adjacent to said 180° inward underfold adapted to permit the gate panel to be severed from the spacer strip at the score line by downwardly applied pressure on the gate panel, said gate panel being maintained in a partially attached relationship with said can lid by the remaining non-folded portion of the periphery of the aperture, said remaining portion defining a hinge for said gate panel.

2. A lid as defined in claim 1, further including a lanced opening along at least a portion of said score line to facilitate the initiation of the tearing and severing of the score line whenever the gate is pushed downwardly.

3. A lid as defined in claim 2, wherein the aperture in the surface of said sheet metal member and the gate panel underneath the aperture are disposed at a non-central location in the can lid towards the wall of the can body, and wherein said non-folded portion of the periphery of said aperture which defines the hinge for the gate panel is the portion of said periphery nearest the wall of the can body.

* * * * *